United States Patent [19]

Hollander

[11] 4,018,129

[45] Apr. 19, 1977

[54] END-PIN HOLDER FOR STRING INSTRUMENTS

[76] Inventor: Ralph Hollander, 425 W. 57th St., New York, N.Y. 11220

[22] Filed: Nov. 26, 1974

[21] Appl. No.: 527,220

[52] U.S. Cl. ..... 84/294; 84/280; 84/327

[51] Int. Cl.[2] ..... G10D 3/02

[58] Field of Search ..... 84/280, 281, 294–296, 84/327, 190

[56] References Cited

UNITED STATES PATENTS

| | | | |
|---|---|---|---|
| 405,323 | 6/1889 | Reynolds | 84/190 |
| 2,974,556 | 3/1961 | Fawick | 84/280 |

FOREIGN PATENTS OR APPLICATIONS

| | | | |
|---|---|---|---|
| 3,244 | 12/1897 | United Kingdom | 84/190 |
| 3,255 | 11/1867 | United Kingdom | 84/190 |

*Primary Examiner*—John Gonzales

[57] ABSTRACT

A resonating end-pin holder for cellos and other string instruments, the holder serving not only to stabilize the instrument with respect to the ground but also to enhance the playing qualities thereof. The holder is constituted by a back plate raised from the ground by feet, above which is a top plate having a socket adapted to receive the end-pin. The top plate, which is spaced from the back plate, is coupled thereto by a sound post that provides an acoustic coupling therebetween. The vibrations of the instrument are transmitted through an end-pin to the plates and radiated thereby but they are isolated from the ground whereby the holder functions as a sympathetic sound board to reinforce the sounds produced by the instrument and to improve its playing qualities.

4 Claims, 8 Drawing Figures

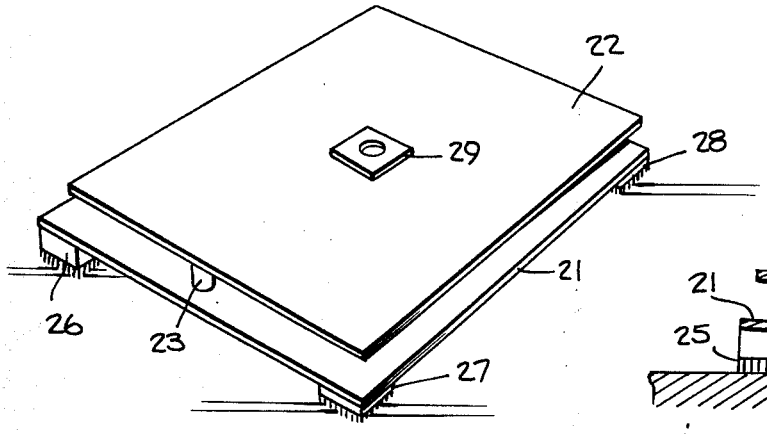
Fig. 2.
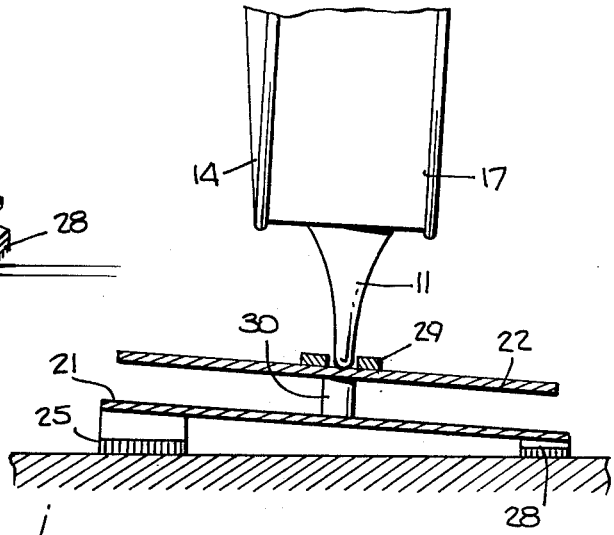
Fig. 3.
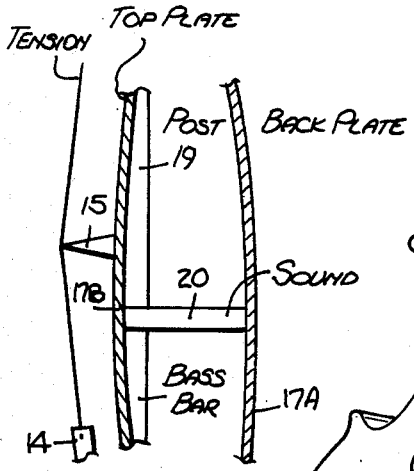
Fig. 1A.
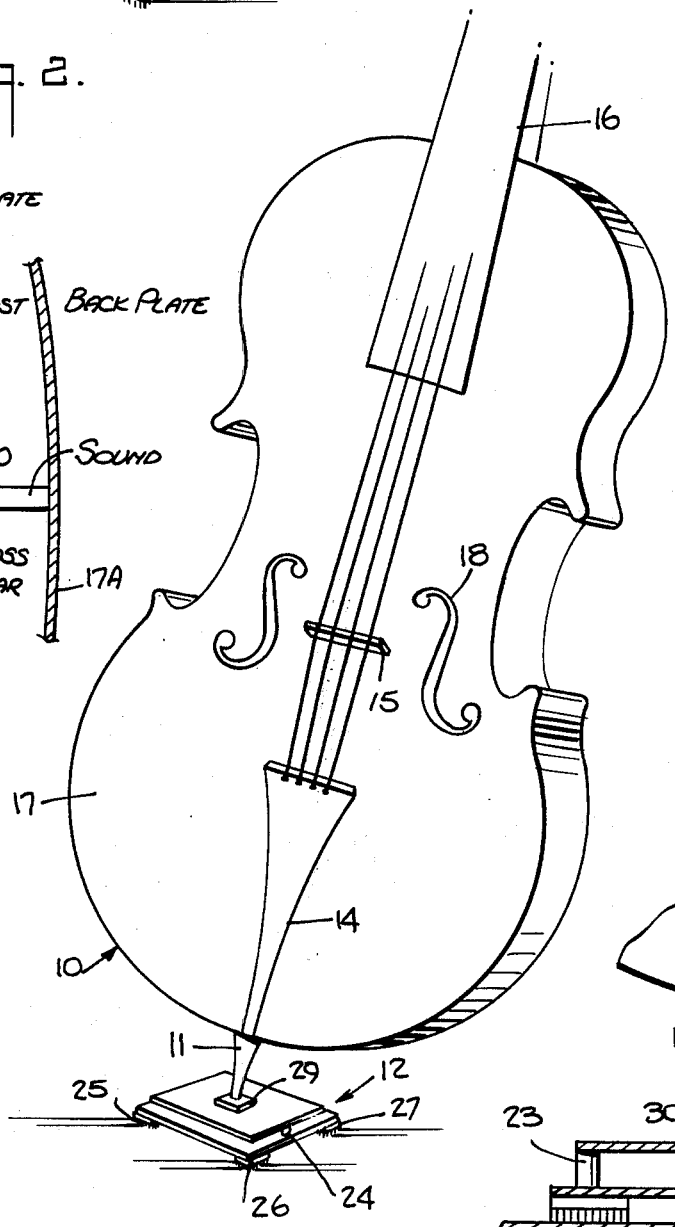
Fig. 1.
Fig. 4.
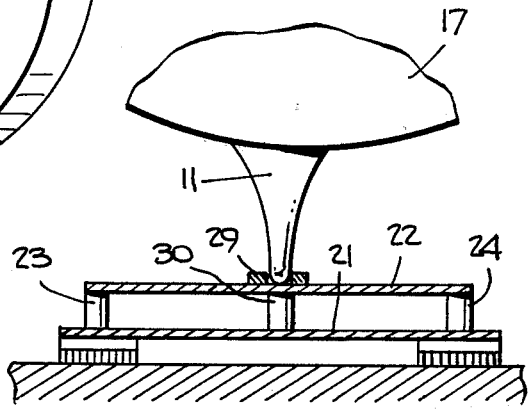

END-PIN HOLDER FOR STRING INSTRUMENTS

BACKGROUND OF INVENTION

This invention relates to resonating end-pin holders for cellos and other string instruments having end-pins, and more particularly to an end-pin holder serving not only to stabilize the instrument with respect to the ground but also to enhance the playing qualities thereof.

The violoncello or cello is the bass member of the violin family and is tuned an octave below the violin. The cello, which is played from a sitting position, is fitted with a projecting end-pin that engages the floor so that the instrument may be held in an almost vertical position. Among other instruments in the violin family also having end-pins or end-rests are the double bass and the gamba. Though the invention will be described in the context of a cello, it is to be understood that a holder in accordance with the invention is applicable to all instruments having end-pins.

In order to resist slippage of the end-pin on the floor as well as to provide a cushioning effect and to protect the floor, it is known to provide a holder that lies on the floor and includes a socket to receive the end-pin. For example, U.S. Pat. No. 2,974,566 discloses an end-rest assembly having a soft-rubber pad formed into a suction cup that attaches to the floor and a socket piece mounted on the pad to accommodate the end pin of the instrument. The sole function of this holder is to anchor the instrument and prevent damage to the floor.

I have found that the end-pin of a string instrument, though necessary to enable playing from a sitting position, has a deleterious effect on the playing qualities of the instrument in that it acts as an acoustic leakage path between the instrument and the ground and thereby transmits vibrations thereto. This leakage dampens and otherwise impairs the tonal characteristics of the instrument. End-pin holders of the type heretofore known do not in any way overcome this drawback.

The loudness or sound amplitude of a cello depends on how strongly the instrument is bowed. If a cello is bowed as strongly as possible, without vibration, and its sound output measured on a sound level meter for each of the notes of the chromatic scale, a curve of sound output vs. frequency may be plotted. This curve is called the loudness curve.

As noted in The Scientific American of November 1974 on "Musical Dynamics" (pages 78 to 95, it is effective dynamic contrast that makes music exciting and for this purpose the minimum requirement is for six dynamic levels in steps of 5 decibels from 0 to 30; that is, a fortissimo 30 db louder than a pianissimo. But experiments conducted at the Massachusetts Institute of Technology demonstrated that cellists were only able to play at dynamic levels ranging from about 3 db to 14 db, thereby depriving the performance of effective dynamic contrast.

I have found that the leakage of acoustic energy which takes place through the end-pin of a cello affects its loudness curve and is of practical significance even when the instrument is played in a small "live" chamber. While the normal volume of sound produced by this instrument in a reflective environment is relatively high, nevertheless the diminution in loudness resulting from leakage adversely affects the playing quality of the instrument. And when this instrument is played in concert on the stage of a large hall, it is desirable from the standpoint both of the player and the listening audience that the cello operate at its maximum acoustic efficiency, for sound emanating from the stage is mainly absorbed rather than reflected in this environment. I have found that the cello and other end-pin instruments do not operate at their maximum acoustic efficiency, so that the requisite dynamic contrast is lacking.

SUMMARY OF INVENTION

In view of the foregoing, it is the main object of this invention to provide a resonating end-pin holder for a string instrument which not only cushions and mechanically stabilizes the instrument on the floor but also enhances the playing qualities thereof and improves dynamic contrast.

More particularly it is an object of this invention to provide a holder of the above type which acoustically isolates the instrument from the ground to minimize the leakage thereto of acoustic energy, the holder at the same time acting as a sympathetic sound board to enhance the tones and amplitude of the instrument, thereby augmenting the natural quality of the instrument and its carrying power.

Also an object of this invention is to provide a resonating end-pin holder having both mechanical and acoustic functions that acts to improve the responsiveness of the instrument and to optimize its acoustic efficiency.

A significant feature of a resonating holder in accordance with the invention is that it makes it possible for the player to bow more easily and to create tones of optimum quality and strength, thereby avoiding excessively strong bowing or forcing of the instrument that produces undesirable tonal effects.

Briefly stated, these objects are accomplished by an end-pin resonating holder for a string instrument having a sound box, the holder in a preferred embodiment of the invention being constituted by a back plate which is raised above the floor by pads or feet of cushioning material, and a top plate supported above the back plate and acoustically coupled thereto by a sound post, the top plate being provided with a socket to receive the end-pin, whereby instrument vibrations transmitted by the end-pin to the resonating holder are isolated from the ground and activate the plates whereby the coupled plates function as a sympathetic sound board to augment the sound produced by the instrument.

OUTLINE OF DRAWING

For a better understanding of the invention as well as other objects and further features thereof, reference is made to the following detailed description to be read in conjunction with the accompanying drawing, wherein:

FIG. 1 is a perspective view of a cello whose end-pin is held by a preferred embodiment of a holder in accordance with the invention;

FIG. 1A is a schematic drawing of the acoustic elements of the cello;

FIG. 2 is a perspective view of the end-pin holder;

FIG. 3 is a transverse section taken through the center of the holder shown in FIG. 2;

FIG. 4 is a longitudinal section taken through the center of the holder shown in FIG. 2;

DESCRIPTION OF INVENTION

Figure 5:
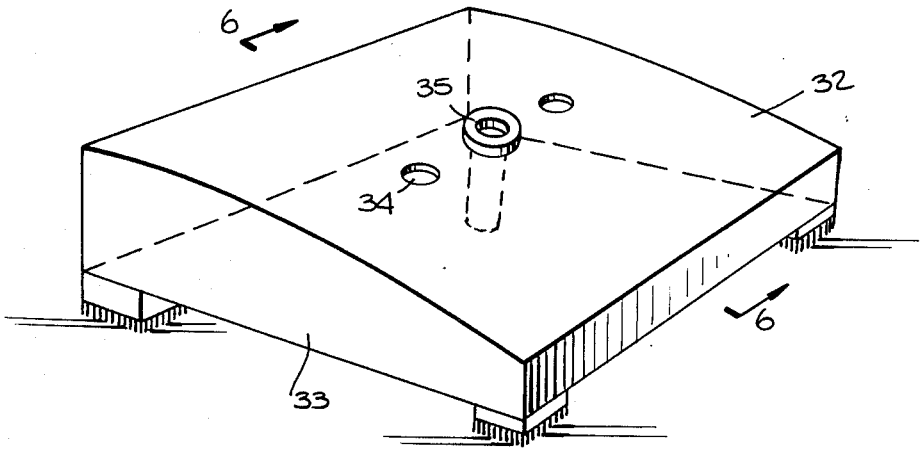
FIG. 5 is a perspective view of another embodiment of a holder in accordance with the invention.

Referring now to FIG. 1, there is shown a standard cello, generally designated by numeral 10, having an end-pin or end-rest 11 extending from the lower end thereof, the end-pin being anchored in a resonating holder 12 in accordance with the invention.

Inasmuch as this holder not only acts to cushion and stabilize the cello but also as a sympathetic or auxiliary sound board to enhance the playing qualities of the cello (or other string instruments having an end-pin), the structure and acoustic behavior of the cello must first be understood in order to appreciate the operating characteristics of the resonating holder and the manner in which it cooperates acoustically with the cello.

In a cello, the string 13, whose vibrations are the original source of sound, are secured at one end to a tail piece 14 mounted at the lower end of the body of the instrument. The strings pass over a bridge 15 and are wound about pegs situated in a peg box (not shown) at the end of a finger board 16 extending from the upper end of the instrument body. The strings are set into vibration by drawing a bow across it.

The vibratory motion of a string which is bowed is a complex wave form containing all of the harmonics or overtones of the fundamental string frequency. The relative amplitude of these harmonics depends on the point in the string where it is bowed as well as on the speed of the bow across the string and the force or bowing pressure exerted on the string. The harmonics of string vibration will appear in the radiated sound, imparting to it a specific tonal quality, color or richness.

The amplitude of string vibration, when bowed at a given point, is a function of the speed at which the bow is drawn across the string and on the distance of the bow from the bridge. These factors will partially determine the loudness of the tone. The tone frequency depends on the mass of the string, its adjusted tension and the length of the string between the bridge and the point where the player's finger presses on it to the fingerboard.

The hollow box 17 or sound board that forms the body of the cello carries out two vital functions. The box supports the strings so that they can vibrate properly, and it renders audible the sounds produced by the strings. The strings themselves disturb very little air and hence radiate almost no sound. The purpose of the box or sound board is to so transmit the string vibrations to the air as to impart thereto the proper loudness and tone.

As shown schematically in FIG. 1A, the cello box or body 17 is constituted by two thin plates of wood; namely the back plate 17A which is the side away from strings 13 and the top plate 17B or belly, which is the side adjacent the strings. These plates are glued to strips of wood called ribs which form the edges of the box and give the instrument its characteristic shape. The air space within the box communicates to the outside through the *f*-holes 18 and in the top plate. The bridge 15 carrying the strings is mounted on top plate 17B midway between *f*-holes 18 as shown in FIG. 1.

The unbowed strings passing over the bridge exert a downward force on it that is conveyed to top plate 17B, as indicated by the arrow in FIG. 1A. A strip of wood 19, called the bass-bar, is installed longitudinally on the under surface of the top plate below bridge 15 to stiffen this plate against the downward force imposed by the strings.

Placed inside the box adjacent the foot of bridge 15 is a short wooden stick or sound post 20. This post extends from top plate 17B to back plate 17A and is held in place by friction. Sound post 20 serves to effect a direct acoustic coupling between the two plates and its position within the box is therefore somewhat critical.

When a string is bowed, its vibrations generated sidewise forces on the bridge and cause the bridge to oscillate in its own plane. These bridge oscillations are transmitted to the sound box and it is the vibrations of the box of the cello that determines how the instrument sounds. Each wood plate has many natural resonance frequencies. The box, being a combination of these two plates, will therefore exhibit a complex spectrum of resonances. In addition, the hollow interior of the box that communicates with the exterior through the *f*-holes forms a Helmholz resonator whose resonance frequency depends mainly on the volume of the box. In contrast to the plate resonances, there is only measurable air resonance.

A more detailed analysis of the acoustics of string instruments may be found in "The Physics of Violins" by Hutchins in The Scientific American of November 1962, pages 78–93, and in the article "Regarding the Sound Quality of Violins and a Scientific Basis for Violin Construction" by Meinel in the Journal of the Acoustical Society of America XXIX (1957), 817–22. A useful discussion of violin string motion is found in J. C. Schelleng's article "The Bowed String" in the American String Teacher XVII (summer 1967), pages 11 to 19.

With the above background in mind, we shall now consider the structure and behavior of a resonating holder in accordance with the invention. The holder, as illustrated in FIGS. 1 to 4, is constituted by a rectangular, flat back plate 21 and a rectangular, flat top plate 22 whih is supported in parallel relation above the back plate by a pair of end spacers 23 and 24.

These plates function as an auxiliary or sympathetic sound board and are therefore formed of materials which correspond to or are compatible with the materials forming the sound box of the cello. Thus back plate 21 may be fabricated of a hard wood such as maple, pearwood or mahogany. The top plate is of a relatively soft wood such as pine, spruce or cedar. In practice one may use synthetic plastic materials in place of natural materials for the plates, provided that the plastics have the requisite resonance properties.

The back and top plate assembly is raised above the floor at a slight angle thereto by a pair of front feet 25 and 26 and a shorter pair of rear feet 27 and 28. The feet are attached to the corners of the back plates and have a tread formation to resist slippage. The feet are fabricated of soft rubber, resilient foam plastic or other suitable cushioning material serving not only to firmly anchor the holder on the floor but also to acoustically isolate the holder so that, in effect, the holder assembly floats acoustically and is free to vibrate and to reflect and radiate sound.

Secured to the center of the top plate is a socket piece 29 having a small hole adapted to receive the point of the end-pin 17 of the instrument being supported. The function of the socket piece is somewhat analogous to that of the instrument bridge in that because the instrument bears down on the socket, it produces a downward tension on the holder plates and acoustically couples the vibrating instrument body to the resonating assembly. Interposed between the two plates is a sound post 30 which acoustically couples the two plates in essentially the same manner as the sound post of the instrument being played.

Thus the resonating holder construction is comparable to that of the sound board or body of the instrument. The end-pin 11 of the instrument transmits the vibrations thereof to the holder and causes the plates thereof to vibrate and radiate to reinforce and thereby enhance the sound of the instrument rather than to dissipate these sounds in the ground as occurs when the end-pin touches the floor directly or is supported by a conventional non-resonating holder.

As is well known to the designers and manufacturers of violins and cellos, wood is a very unpredictable material in that each piece is different from every other piece. For these reasons it is difficult to predetermine the optimum thickness of the top and back plates that will impart the desired resonance frequencies to the body of the instrument. Each individual piece of wood forming the box of the instrument must be worked to the right thickness, tap tones being used to determine how far to thin down the plates. While the holder plates also have resonance frequencies, these are less critical than those of the instrument body. Nevertheless, one cannot prescribe in advance the preferred thickness of these plates, and empirical methods must be used for this purpose to determine the appropriate parameters.

Figure 6:
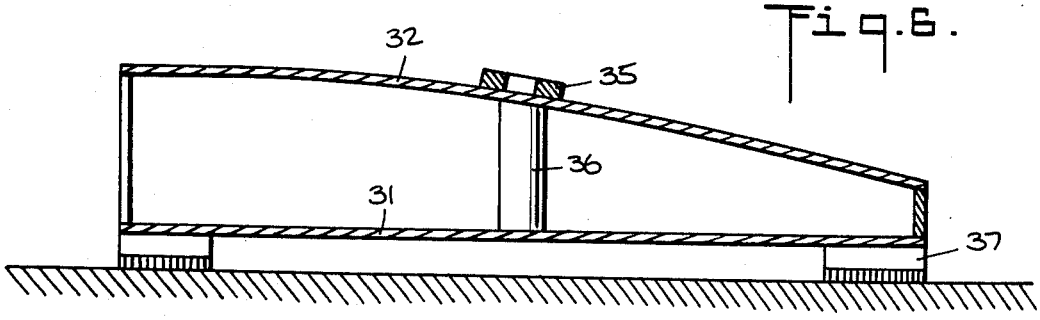
FIG. 6 is a transverse section taken through the holder shown in FIG. 5.

In the embodiment shown in FIGS. 5 and 6, the structure of the sympathetic sound board more closely approaches that of the body of the instrument in that while back plate 31 is flat, the top plate 32 has a half-belly formation and is marginally secured to the back plate by side pieces whose function is comparable to the ribs of a cello. Thus the holder box is enclosed to define an air chamber having air resonance characteristics. Holes 33 and 34 may be cut into the top plate 32 on either side of the center socket piece 35, the holes having the same function as the *f*-holes in the instrument.

A sound post 36 acts to acoustically couple top plate 32 to back plate 31. The holder in this instance is raised above the floor by four like feet 37 in that the inclination of the holder relative to the instrument is effected by the half-belly formation of the top plate. Thus the holder in FIGS. 5 and 6 behaves as a miniature sound box which is acoustically coupled to the body of the instrument and radiates the vibrations thereof to reinforce the sounds produced by the instrument.

Figure 7:
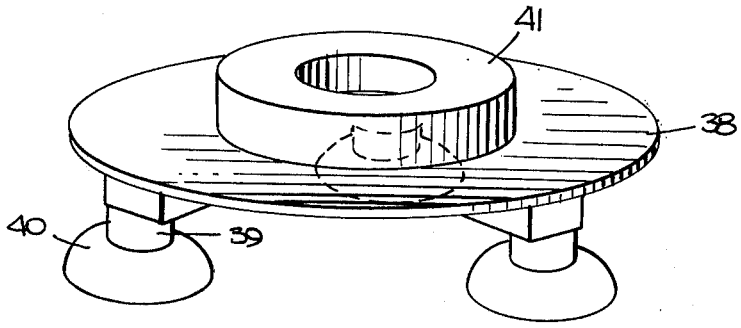
FIG. 7 is a perspective view of a third embodiment of a holder in accordance with the invention.

In the simpler embodiment shown in FIG. 7, the holder only has a disc-shaped back plate 38 which is raised above ground by three legs 39 terminating in suction cups 40 adapted to grip the floor. The annular piece 41 centrally mounted on the back plate functions as the socket for the end-pin of the instrument. In this instance, therefore, the back plate is set into vibration by vibrations transmitted thereto by the end-pin of the instrument.

Thus the resonating holders in accordance with the invention do more than merely stabilize the instrument, for the holder acts as an auxiliary sound board, performing a useful acoustic function. The end-pin of the instrument being held, instead of serving as a grounding path or vibrations produced by the instrument, now functions to acoustically couple these vibrations to the radiating auxiliary sound board, thereby improving the playing qualities of the instrument and enhancing the tonal characteristics thereof.

While there have been shown and described preferred embodiments of resonating end-pin holders for string instruments in accordance with the invention, it will be appreciated that many changes and modifications may be made therein without, however, departing from the essential spirit thereof.

I claim:

1. A resonating holder for a string instrument having a body formed by a sound box provided with a back plate acoustically coupled to a top plate by a sound post, the body having an end-pin extending from the lower end thereof, the end-pin when in direct engagement with the ground producing a dampening effect, said holder comprising:

A. a back plate provided with ground-engaging feet formed of material serving to acoustically isolate the back plate from the ground whereby the back plate floats acoustically and is free to vibrate, B. a top plate supported in spaced relation above said back plate to define an open zone therebetween, C. a sound post interposed between and acoustically intercoupling said top plate and back plate, each plate being characterized by multiple natural resonance frequencies, and D. a socket for receiving the end-pin of the instrument and mounted on said top plate whereby said back plate and said top plate are excited into vibration by instrument vibrations transmitted thereto through said end-pin and said holder serves to acoustically reinforce said instrument without damping, said top and back plates being formed of material acoustically compatible with the top and back plates of the instrument being played.

2. A holder as set forth in claim 1, wherein said top and back plates are formed by flat, rectangular sheets of wood.

3. A holder as set forth in claim 2, wherein said back plate is fabricated of hard wood and said top plate is formed of relatively soft wood.

4. A holder as set forth in claim 1, wherein said feet are formed of resilient material.

* * * * *

UNITED STATES PATENT AND TRADEMARK OFFICE

CERTIFICATE OF CORRECTION

PATENT NO. : 4,018,129

DATED : April 19, 1977

INVENTOR(S) : RALPH HOLLANDER

It is certified that error appears in the above-identified patent and that said Letters Patent are hereby corrected as shown below:

Column 1, line 26 "2,974,566" should have read -- 2,974,556 --

Column 4, line 43 "whih" should have read -- which --
Column 6, line 12 "or" should have read -- of --
Column 4, line 13 "generated" should have read -- generate --

Signed and Sealed this

*ninth* Day of *August 1977*

[SEAL]

*Attest:*

RUTH C. MASON
*Attesting Officer*

C. MARSHALL DANN
*Commissioner of Patents and Trademarks*